US009185949B1

(12) United States Patent
Kidwell

(10) Patent No.: US 9,185,949 B1
(45) Date of Patent: Nov. 17, 2015

(54) TRACTION DEVICE FOR FOOTWEAR

(71) Applicant: William Warren Kidwell, Port Richey, FL (US)

(72) Inventor: William Warren Kidwell, Port Richey, FL (US)

( * ) Notice: Subject to any disclaimer, the term of this patent is extended or adjusted under 35 U.S.C. 154(b) by 0 days.

(21) Appl. No.: 14/791,189

(22) Filed: Jul. 2, 2015

(51) Int. Cl.
*A43C 15/10* (2006.01)
*A43C 15/06* (2006.01)
*A43C 15/00* (2006.01)

(52) U.S. Cl.
CPC ..... *A43C 15/10* (2013.01); *A43C 15/00* (2013.01); *A43C 15/063* (2013.01)

(58) Field of Classification Search
CPC ..... A43C 15/00; A43C 15/10; A43C 15/06; A43C 15/061; A43C 15/063
USPC ..... 36/7.6, 7.7, 59 R, 62
See application file for complete search history.

(56) References Cited

U.S. PATENT DOCUMENTS 1,194,191 A * 8/1916 Kirkwood ..... 36/62
1,293,349 A * 2/1919 Cotter ..... 36/7.6
1,492,513 A * 4/1924 Groebl ..... 36/62
1,508,214 A * 9/1924 Brown ..... 36/62
1,597,710 A * 8/1926 Bartlett ..... 36/62
1,862,438 A * 6/1932 Simonson ..... 36/7.7
1,982,510 A * 11/1934 Frazey ..... 36/62
2,065,727 A * 12/1936 Norman ..... 36/62
2,697,287 A * 12/1954 Millard ..... 36/7.7
3,583,083 A * 6/1971 Drew ..... 36/62
8,256,140 B2 * 9/2012 Lagrand et al. ..... 36/7.6
2006/0156577 A1 * 7/2006 Choi ..... 36/7.6
2007/0163146 A1 * 7/2007 Brovkin ..... 36/7.6
2007/0283596 A1 * 12/2007 Park ..... 36/62
2011/0258878 A1 * 10/2011 Jones et al. ..... 36/62

* cited by examiner

*Primary Examiner* — Marie Bays
(74) *Attorney, Agent, or Firm* — Inventions International Inc.; Tiffany C. Miller

(57) ABSTRACT

A traction device has a pliable securing portion configured to connect the traction device to footwear. A traction portion forms a barrier between the outsole of footwear and a surface. A retainer having retainer ends is configured to be retained by a compartment within the securing portion. A portion of at least one link of the traction portion is configured to connect to a retainer within a compartment when a portion of the link is received by an opening in the wall surface of the compartment. At least one traction portion is configured to be removable from the traction device. At least one retainer end is removable. When the retainer end is removed from the retainer, the retainer can then receive a replaceable traction device or a traction portion can be removed from the traction device. The wall surface of the compartment can have a plurality of openings.

5 Claims, 5 Drawing Sheets

TRACTION DEVICE FOR FOOTWEAR

BACKGROUND OF THE INVENTION

1. Field of the Invention

This invention relates, generally, to a traction device for footwear. More particularly, it relates to a traction device having a pliable securing portion configured to conform around a user's footwear.

2. Background Art

Traction devices for footwear currently being manufactured can span the length of the outsole of a shoe. The Yaktrack Walk Traction system has a securing portion connected to the perimeter of a shoe and has a traction portion being a metal coil overlapping a length of thermal plastic elastomer material covering a substantial portion of the outsole of a shoe. When the traction portion spans the entire length of the outsole of a shoe, it requires more material to manufacture, which can be costly. Additionally, damage can occur to the perimeter of a shoe when the securing portion of a traction device rubs against the shoe material. Thus, there is a need for a traction device that can be connected to a portion of a user's footwear without having to be in contact with the entire perimeter of a shoe.

Currently, Kako Icetrekkers Traction System, Diamond Grip can be attached to the perimeter of a shoe with a rubber harness. This system utilizes a plurality of steel alloy projections connected to a cable configured to overlay the heel portion and the forefoot portion of the outsole of a shoe. This traction device can be bulky and heavy for a user to walk with which may result in a user tripping and become injured. It would be more desirable for a traction device for footwear to be lighter in weight and less bulky.

However, in view of the prior art considered as a whole at the time the present invention was made, it was not obvious to those of ordinary skill in the pertinent art how the identified needs could be fulfilled.

SUMMARY OF THE INVENTION

The long-standing but heretofore unfulfilled need for a traction device having a pliable securing portion configured to connect the traction device to footwear and a traction portion forming a barrier between a portion of the outsole of footwear and a walking surface which also includes improvements that overcome the limitations of prior art traction footwear covers is now met by a new, useful, and non-obvious invention.

In a preferred embodiment, a traction device for footwear has a pliable securing portion with a primary end having a primary opening located opposite a secondary end having a primary opening. The primary opening of the primary end of the securing portion forms a primary compartment. The primary opening of the secondary end of the securing portion forms a secondary compartment. At least one traction portion has a primary end located opposite a secondary end, whereby, at least one traction portion has a plurality of connected links.

A wall surface of the primary compartment has an opening configured to receive a portion of at least one link. A wall surface of the secondary compartment has an opening configured to receive a portion of at least one link. A primary retainer has a primary retainer end located opposite a secondary retainer end. It is within the scope of this invention for the retainer end to be removable. The primary retainer is configured to be retained by the primary compartment, whereby, a portion of at least one link is configured to connect to the primary retainer within the primary compartment when a portion of at least one link is received by the at least one opening in the wall surface of the first compartment.

A secondary retainer has a primary retainer end located opposite a secondary retainer end. The secondary retainer is configured to be retained by the secondary compartment. A portion of at least one link is configured to connect to the secondary retainer within the secondary compartment when a portion of at least one link is received by the at least one opening of the wall surface of the secondary compartment.

In an alternate embodiment, the novel traction device can have a securing portion having an adjustable attaching element connected thereto. An attaching element includes, but is not limited to, a hook and loop attachment, a latch, a button, or a clasp. A user can tighten or loosen the traction device for installation or removal of the traction device on footwear.

In another embodiment, the novel traction device can have at least one traction portion configured to be removable from the traction device. At least one retainer end is removable. When the retainer end has been removed, the retainer can then receive a replaceable traction device or a traction portion can be removed from the traction device. The traction device can have a single traction portion. A traction device includes, but is, not limited to, a plurality of links. A user can add additional traction portions to the traction device for an increase in traction. The wall surface of the compartments can have a plurality of openings to accommodate a plurality of traction portions being added to the retainer.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
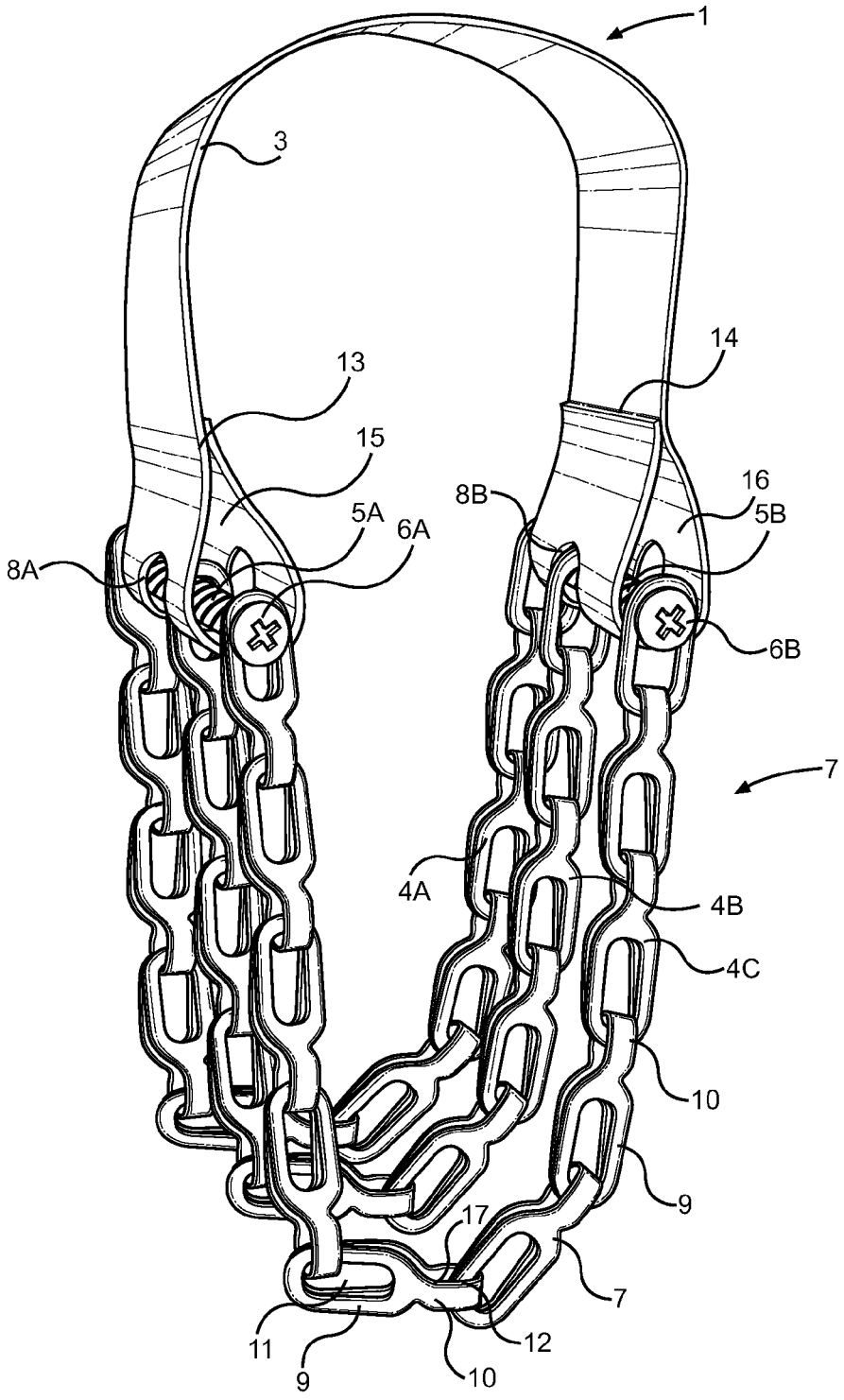
FIG. 1 is a perspective view of the novel traction device.

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

In a general embodiment, novel traction device 1 has pliable securing portion 3 configured to conform around footwear including, but not limited to, a shoe or a boot. A retainer 5A and 5B is connected to each one of securing portion 3. Retainer 5A and 5B can include, but is not limited to, a threaded rod, a screw, or a rod. Retainers 5A and 5B each have a retainer end 6A and 6B. A retainer end includes, but is not limited to, a nut, a locking nut, a screw head, or a clamp. The retainer ends 6A and 6B each retain a portion of link 7 of traction portions 4A and 4C onto retainers 5A and 5B. Each end 13 and 14 of securing portion 3 each has a pocket having an opening that receives a retainer. At least one retainer end can be removable during installation of the replaceable traction portions.

At least one opening 8A and 8B is located on an end portion 13 and 14 of securing portion 3. Opening 8A and 8B are configured to receive a portion of link 7 of traction portion 4B configured to receive retainer 5A and 5B, thereby, retaining retainer 5A and 5B within primary and secondary end portions 13 and 14.

In a preferred embodiment, a plurality of replaceable traction portions 4A, 4B, and 4C each having a plurality of links are retained by removable retainers 5A and 5B. The traction portions include, but are not limited to, plumber's chain. Each link 7 has a flattened link portion 9 having an opening 11 located opposite a protruding link portion 12 having an opening. The flattened link portion 9 and the protruding link portion 12 are connected at an end of flattened link portion 17.

It is within the scope of this invention for the traction portions to be removable and replaceable from the retainer when at least one removable retainer end is removed from the retainer. Additional traction portions can be added to retainers 5A and 5B for more traction. It is within the scope of this invention for the wall surface of the compartments of the securing portion to have more than one opening to receive a portion of at least one link, allowing the link to connect to a retainer retained within the compartment. For example, a user can use a quantity of five (5) traction portions (not shown) when a user is walking on slippery surfaces such as ice, snow, oil or grease. Tractions portions can be individually replaced if they become damaged from corrosion or if the links become deformed.

Construction of the Novel Traction Device

Figure 2:
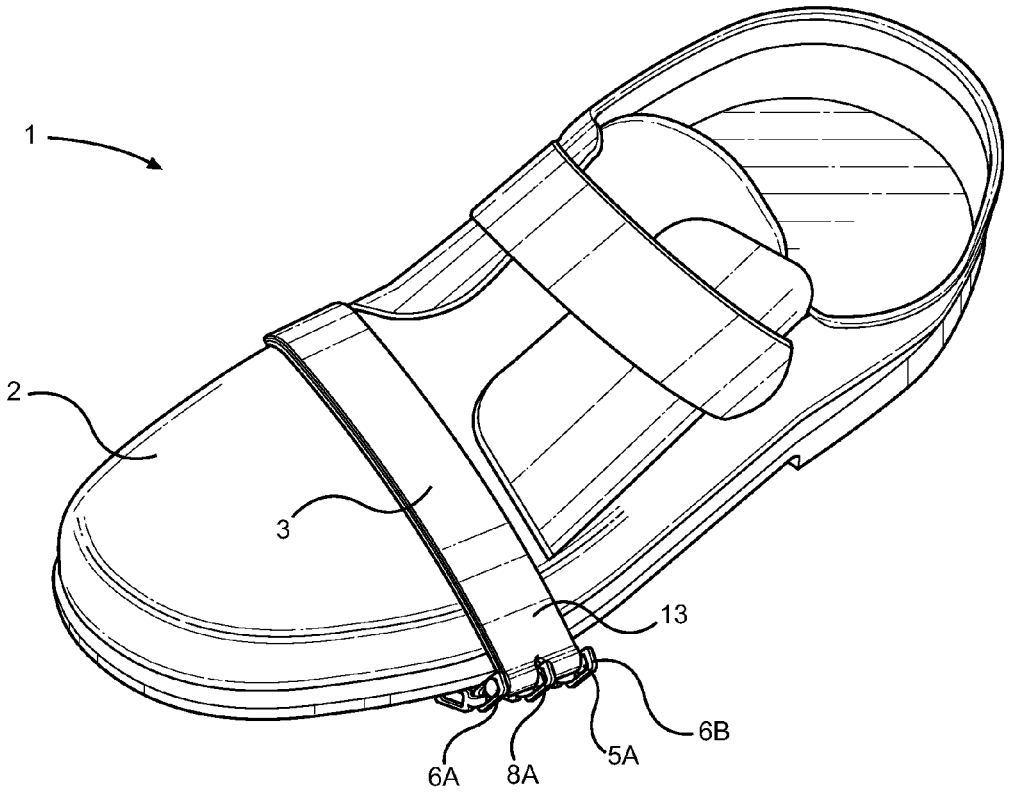
FIG. 2 is a perspective top view of the novel traction device having a securing portion conforming around a portion of a shoe.
Figure 3:
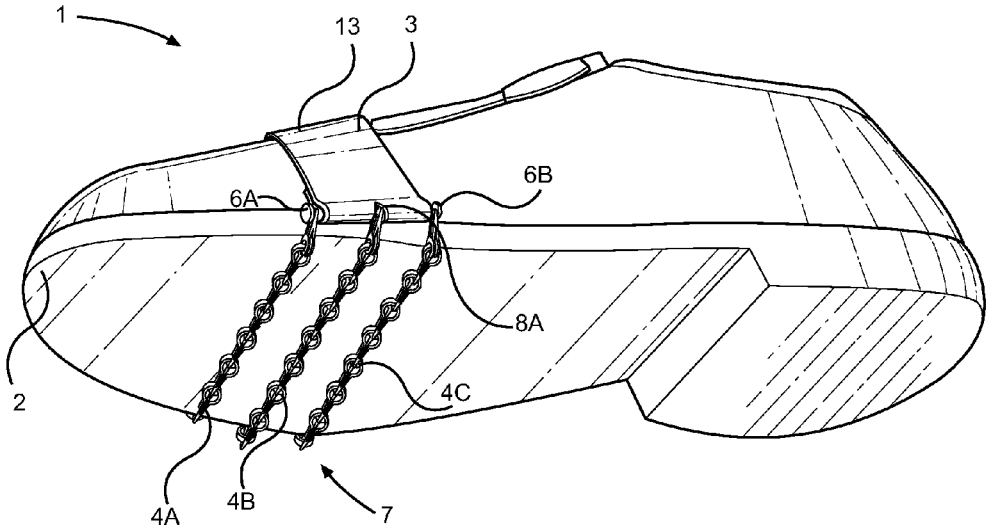
FIG. 3 is a perspective bottom view of the novel traction device having a traction portion conforming around a portion of a shoe.
Figure 4:
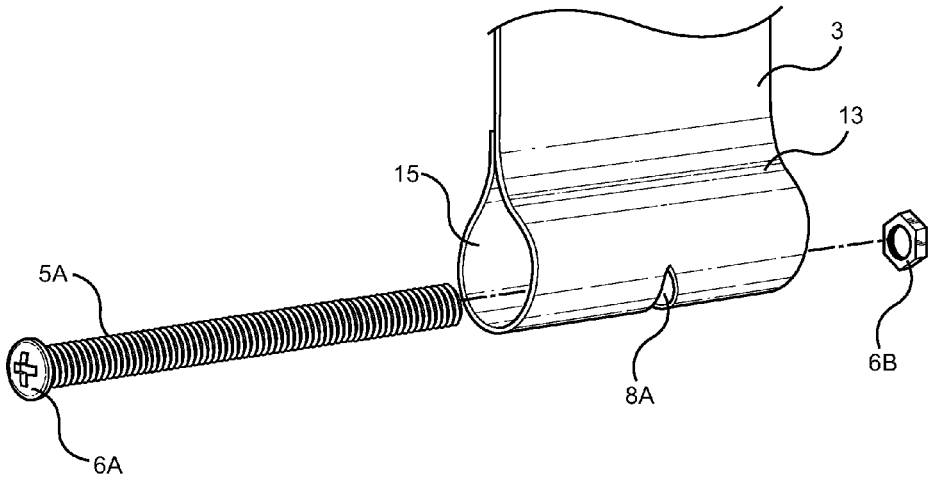
FIG. 4 is an exploded partial view of the novel traction device having a retainer, a retainer end, and a compartment formed from a securing portion.
Figure 5:
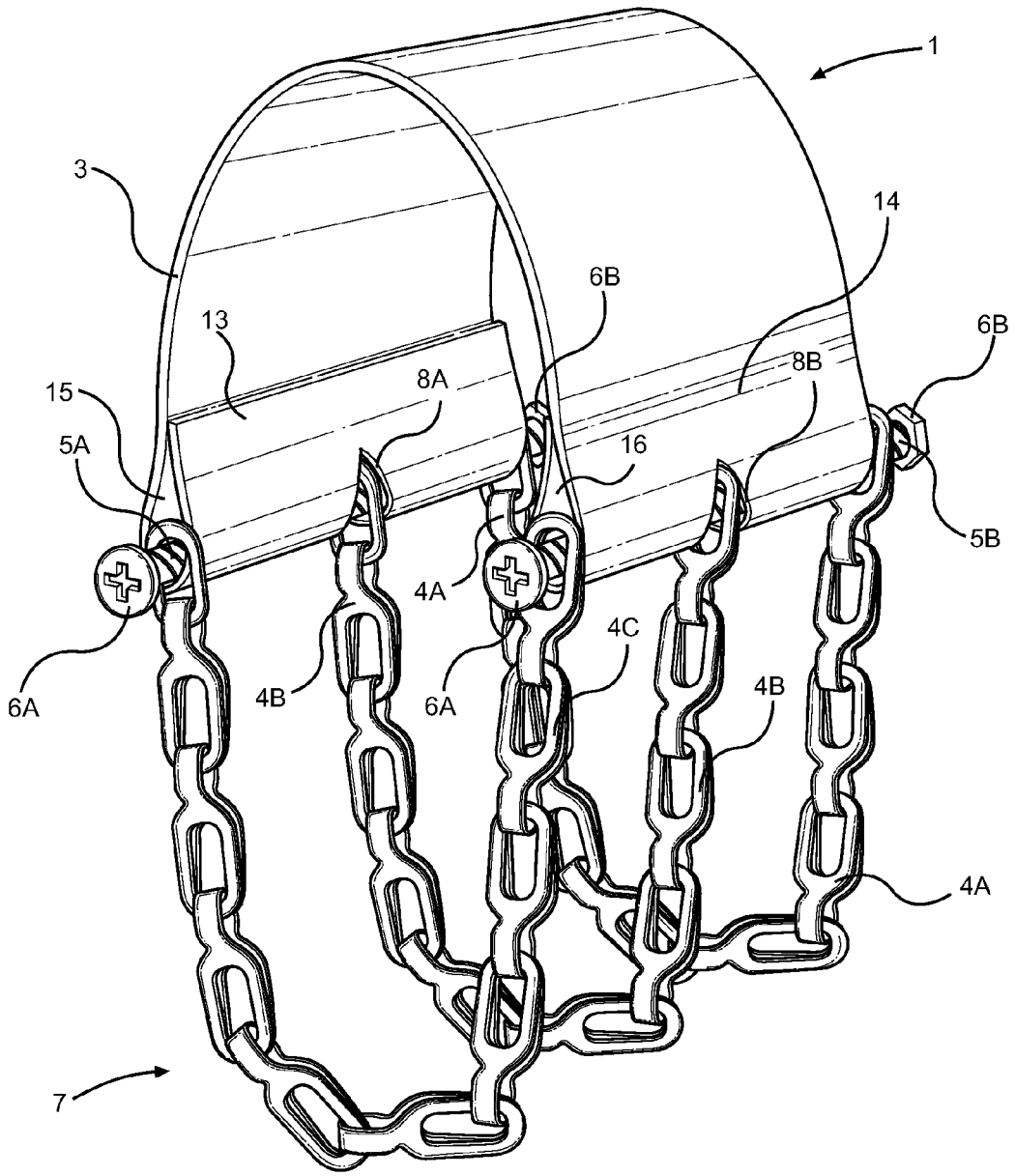
FIG. 5 is a perspective view of the novel traction device.

It will now be seen, referring to FIGS. 1, 2, 3, 4, and 5 the novel traction device 1 includes securing portion 3 having primary end 13 located opposite secondary end 14 (FIGS. 1 and 5). Primary end 13 of securing portion 3 has primary opening 15 (FIGS. 1, 4, and 5). FIGS. 1 and 5 best illustrate secondary end 14 of securing portion 3 having secondary opening 16. Retainer 5A has primary retainer end 6A located opposite secondary retainer end 6B. Retainer 5B has primary retainer end 6A located opposite secondary retainer end 6B (FIGS. 1 and 5). Primary end 13 of securing portion 3 has primary opening 8A. Secondary end 14 of securing portion 3 has secondary opening 8B (FIGS. 1 and 5). Traction device 1 conforms to shoe 2 (FIGS. 2 and 3).

Figure 6:
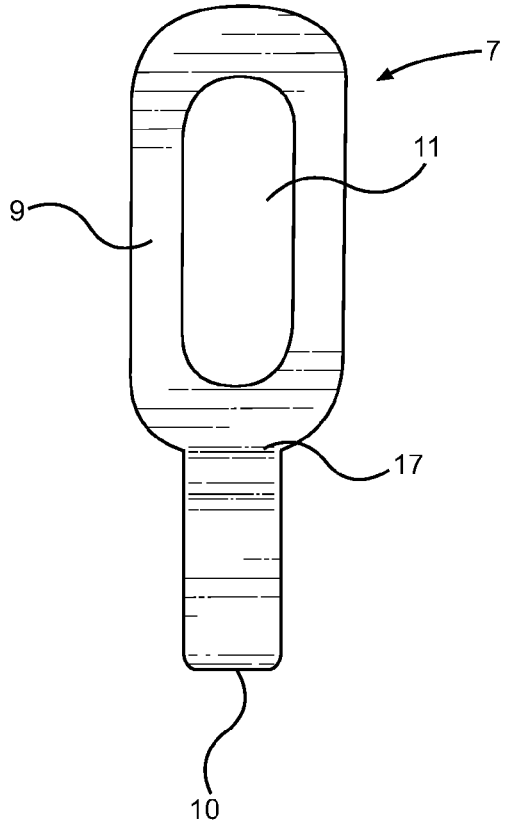
FIG. 6 is a perspective view of the novel traction device traction link; and, FIG. 7 is a perspective view of the novel traction device traction link.
Figure 7:
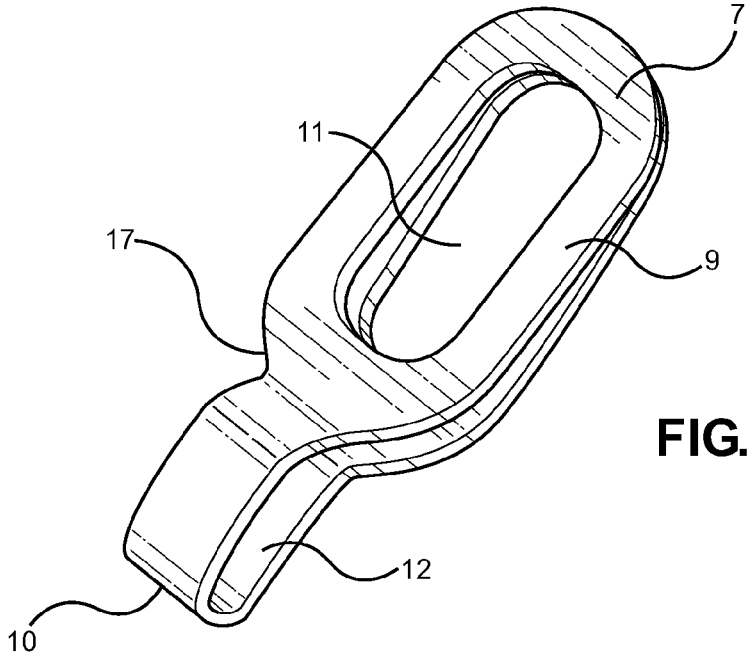

FIGS. 1, 3, and 5 illustrate primary traction portion 4A, secondary traction portion 4B, and tertiary traction portion 4C having a plurality of links 7. FIGS. 6 and 7 best depict link 7 having primary portion 9 having primary opening 11 located opposite secondary portion 10 having secondary opening 12. Primary portion 9 of link 7 has end portion 17 connected to secondary portion 10 of link 7.

Portable traction device 1 is compact and can easily fit into a pocket (not shown) of a user's garment (not shown). When traction device 1 is worn around shoe 2, a user can safely transition from a slippery surface such as ice to another surface such as pavement resulting from the non-bulky and light weight features of novel traction device 1.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. A traction device for footwear, comprising:

a pliable securing portion having a first end located opposite a second end, said first end of said pliable securing portion having a first compartment, said second end of said pliable securing portion having a second compartment;

said first compartment comprising a first opening of said first compartment located opposite a second opening of said first compartment, said first compartment having a third opening, a first retainer having a first retainer end located opposite a second retainer end, said first retainer is connected to an inner wall surface of said first compartment;

said second compartment comprising a first opening of said second compartment located opposite a second opening of said second compartment, said second compartment having a third opening, a second retainer having a first retainer end located opposite a second retainer end, said second retainer is connected to an inner wall surface of said second compartment;

a first traction portion having a first end located opposite a second end, whereby, said first traction portion comprising a plurality of connected links, said first end of said first traction portion is connected to said first retainer, whereby, said first end of said first traction portion is located adjacent to said first end of said first retainer, said second end of said first traction portion is connected to said second retainer, whereby, said second end of said first traction portion is located adjacent to said first end of said second retainer;

a second traction portion having a first end located opposite a second end, whereby, said second traction portion comprising a plurality of connected links, said first end of said second traction portion is received by said third opening of said first compartment, whereby, said first end of said second traction portion is connected to a substantially central portion of said first retainer, said second end of said second traction portion is received by said third opening of said second compartment, whereby, said second end of said second traction portion is connected to a substantially central portion of said second retainer; and, a third traction portion having a first end located opposite a second end, whereby, said third traction portion comprising a plurality of connected links, said first end of said third traction portion is connected to said first retainer, whereby, said first end of said third traction portion is located adjacent to said second end of said first retainer, said second end of said third traction portion is connected to said second retainer, whereby, said second end of said third traction portion is located adjacent to said second end of said second retainer.

2. The traction device for footwear of claim 1, wherein said securing portion having an adjustable attaching element connected thereto.

3. The traction device for footwear of claim 1, wherein at least one end of said first retainer is a locking nut.

4. The traction device for footwear of claim 1, wherein said traction device having a plurality of traction portions.

5. The traction device for footwear of claim 1, wherein at least one end of said second retainer is a clamp.

* * * * *